US005929363A

United States Patent [19]

Neff et al.

[11] Patent Number: 5,929,363

[45] Date of Patent: Jul. 27, 1999

[54] METHOD AND APPARATUS FOR DESTROYING HIDDEN LAND MINES

[75] Inventors: Helmut Neff, Hermannsburg; Alexei Voronov, Unterlüss; Dirk Kilfitt, Velbert, all of Germany

[73] Assignees: Rheinmetall W & M GmbH, Ratingen; TZN Forschungs- und Entwicklungszentrum Unterlüss, Unterlüss, both of Germany

[21] Appl. No.: 09/053,523

[22] Filed: Apr. 2, 1998

[30] Foreign Application Priority Data

Apr. 5, 1997 [DE] Germany ..... 197 14 133

[51] Int. Cl.[6] ..... B64D 1/04

[52] U.S. Cl. ..... 89/1.13

[58] Field of Search ..... 89/1.13, 1.1, 1.11; 102/402, 403

[56] References Cited

U.S. PATENT DOCUMENTS

| | | | |
|---|---|---|---|
| 3,639,150 | 2/1972 | Suhara et al. | 117/93 |
| 3,877,373 | 4/1975 | Bergmann | 102/23 |
| 5,238,063 | 8/1993 | Bebert . | |
| 5,573,307 | 11/1996 | Wilkinson et al. | 299/14 |
| 5,808,969 | 9/1998 | Arnaud et al. | 367/106 |

FOREIGN PATENT DOCUMENTS

| | | |
|---|---|---|
| 412 609 | 7/1910 | France . |
| 2 757 622 | 6/1998 | France . |
| 72 744 | 5/1893 | Germany . |
| 72744 | 5/1893 | Germany . |
| 37 00 385 | 4/1988 | Germany . |
| 37 00 385 C1 | 4/1988 | Germany . |

*Primary Examiner*—Charles T. Jordan
*Assistant Examiner*—Jeffrey Howell
*Attorney, Agent, or Firm*—Venable; Gabor J. Kelemen

[57] ABSTRACT

A method of destroying hidden land mines includes steps of providing a hole in the ground of a mine-contaminated area; placing into the hole a device which generates a shock wave by wire explosion; connecting the device to a switchable current source; and applying a current pulse from the current source to the device for causing a wire explosion thereof to generate a shock wave in the ground for destroying mines hidden in the area within the effective range of the shock wave. The device has a plastic tube filled with a liquid; a wire passing through the liquid; and electrodes disposed at opposite ends of the tube. The wire is connected to the electrodes, and the electrodes are connectable to a current source for applying a current pulse from the current source to the wire to effect explosion thereof for generating the shock wave.

6 Claims, 1 Drawing Sheet

METHOD AND APPARATUS FOR DESTROYING HIDDEN LAND MINES

CROSS REFERENCE TO RELATED APPLICATION

This application claims the priority of German Application No. 197 14 133.1 filed Apr. 5, 1997, which is incorporated herein by reference.

BACKGROUND OF THE INVENTION

This invention relates to a method and an apparatus for destroying hidden land mines.

For clearing mine barriers and mine fields expensive and tire consuming operations are needed. Particular problems are involved with the clearing of plastic mines having a small metal proportion. Such mines, as a rule, may be located only with special mine sondes and are subsequently often eliminated by using explosive cartridges.

It is a disadvantage of the above-noted conventional method that for clearing the mines explosives have to be used which involves an additional safety hazard for the personnel performing the mine clearing.

German Patent No. 37 00 385 discloses a deliberate destruction of sea mines by directing a number of superposed shock waves of relatively small intensity to the previously determined location of the mine. It is a disadvantage of this method—which has been derived from medical applications—that the position of the mine to be destroyed must be known with accuracy. This, however, is, as a rule, not feasible in case of hidden land mines.

SUMMARY OF THE INVENTION

It is an object of the invention to provide an improved method and apparatus for destroying hidden land mines, particularly plastic mines, which makes possible an economical clearing without the use of explosives.

This object and others to become apparent as the specification progresses, are accomplished by the invention, according to which, briefly stated, the method of destroying hidden land mines includes the steps of providing a hole in the ground of a mine-contaminated area; placing into the hole a device which generates a shock wave by wire explosion; connecting the device to a switchable current source; and applying a current pulse from the current source to the device for causing a wire explosion thereof to generate a shock wave in the ground for destroying mines hidden in the area within the effective range of the shock wave.

Thus, the basic principle of the invention in clearing mines resides in that in the area where the presence of mines is suspected, shock waves are generated by means of a wire explosion, and such shock waves cause ignition of the mines situated in that area. Similarly to conventional methods where explosives are used, an exact pinpointing of the mines may be dispensed with.

For generating the shock waves a prefabricated (for example, cartridge shaped) device is used which includes a plastic tube containing a liquid, preferably water. At the ends of the plastic tube electrodes are positioned which hold a wire extending within the liquid-filled tube. If a pulse of a sufficiently high current intensity is generated (for example by discharging a condenser battery) and passed through the wire, the latter vaporizes in the liquid and generates a short, powerful pressure increase (shock or thrust wave) in the liquid. The shock is transmitted into the soil surrounding the device and ignites any mine situated in such area. The range of the shock waves depends on the applied power pulse and may amount to several meters.

For performing the method according to the invention a vehicle, by means of an earth boring device or a high pressure water jet, provides holes in the soil and thereafter inserts into the holes the devices (cartridges) for generating the wire explosions. Subsequently, the cartridges are connected with a current source by means of a cable and the wire explosion is triggered from a suitable shelter. The clearing of the entire mine field may be performed by following a grid pattern.

By means of suitable drilling devices simultaneously a plurality of holes may be provided for accommodating the explosive wire device. Further, to avoid to the greatest possible extent an endangerment of the operating personnel while the bore holes are provided and the explosive wire devices are inserted, it has been found advantageous to utilize remote-controlled, autonomous (unmanned) vehicle systems.

The method according to the invention may be advantageously used within the framework of quality-assuring measures following a mechanical mine clearing (such as clearing by mine-sweeping vehicles which explode the mines, for example, by running over them).

DESCRIPTION OF THE PREFERRED EMBODIMENTS

Figure 1:
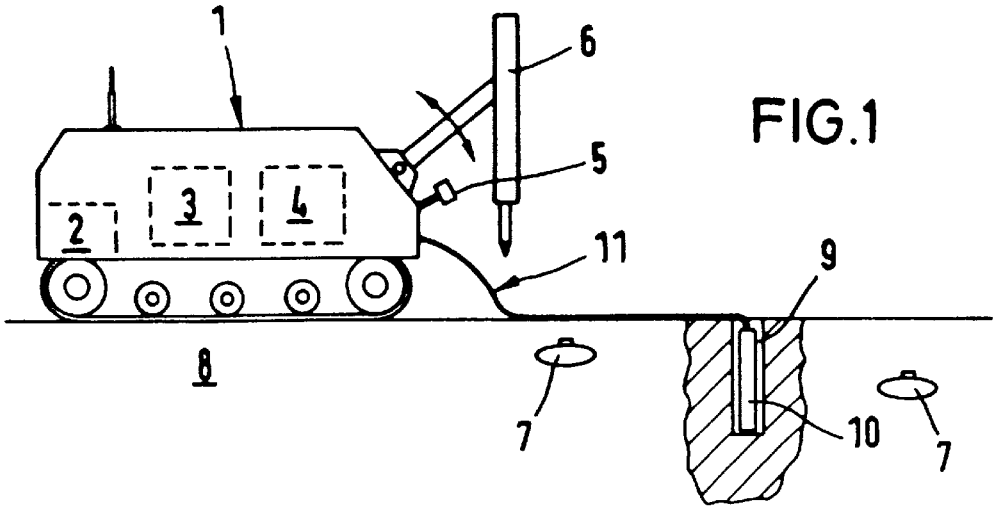
FIG. 1 is a schematic side elevational view illustrating the method according to the invention, showing an autonomous track-laying vehicle which is connected by means of a cable with a device accommodated in a hole drilled in the soil.

Turning to FIG. 1, an unmanned armored track-laying vehicle 1 is in communication with a non-illustrated control center. The inside of the vehicle 1 accommodates a vehicle power plant 2, a steering apparatus 3 and a current source 4 for generating short current pulses of high intensity. In addition, on the outside the vehicle 1 has, among others, a monitoring camera 5, a drilling device 6 and a gripping device which is not illustrated for the sake of clarity.

Plastic mines 7 are hidden in the ground 8. A hole 9 previously provided by the drilling device 6 accommodates a device 10 according to the invention. The device 10 is connected by an electric cable 11 with the current source 4 accommodated in the vehicle 1.

Figure 2:
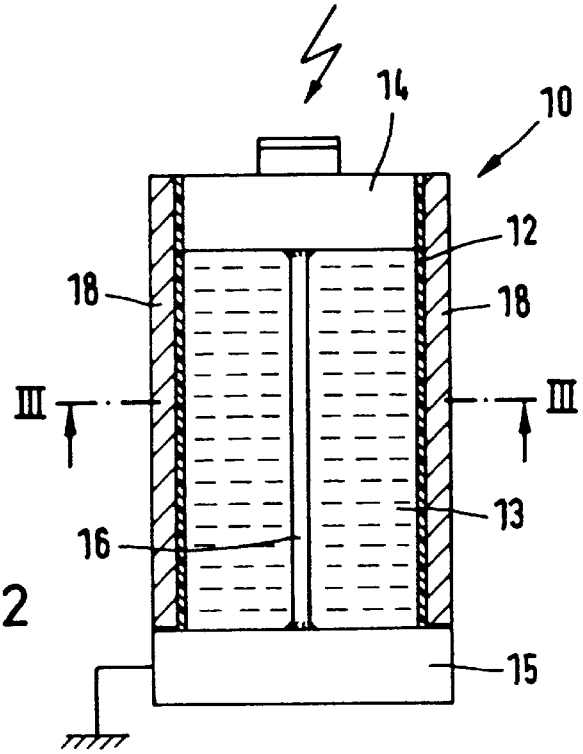
FIG. 2 is a longitudinal sectional view, on an enlarged scale, of a device according to the invention.
Figure 3:
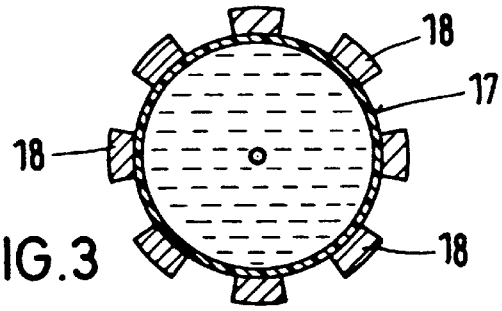
FIG. 3 is a sectional view taken along line III—III of FIG. 2.

Turning to FIGS. 2 and 3, the device according to the invention includes a plastic tube 12 filled with liquid (such as water) 13. On opposite ends of the tube 12 electrodes 14 and 15 are arranged which are connected with respective ends of a wire 16 submerged in the liquid 13 filling the tube 12. On the outside 17 of the plastic tube 12 eight strip-like electric connections 18 are provided which are connected with the electrode 15 grounded by the neutral wire of the cable 11.

For performing the method according to the invention, the vehicle drills a hole 9 approximately 0.5 to 1.0 meter deep into the soil 8 by means of the drilling device 6. Thereafter the non-illustrated gripper mounted on the vehicle 1 inserts the device 10 into the hole 9 and connects the device 10 by means of the pre-arranged cable 11 with the current source 4.

Thereafter the vehicle 1 is moved away slightly from the hole 9, whereupon the current source 4 is switched on to generate a current pulse which has a current intensity sufficient for causing a wire explosion. As a result, the wire 16 vaporizes in an impact-like manner and generates a short-period, steep pressure increase in the liquid 13. Such a pressure pulse is transmitted to the surrounding soil region. The shock wave generated by the wire explosion has, dependent upon the pulse power, a range of several meters and causes ignition and thus destruction of the mines 7 which are situated in that area.

It will be understood that the above description of the present invention is susceptible to various modifications, changes and adaptations, and the same are intended to be comprehended within the meaning and range of equivalents of the appended claims.

What is claimed is:

1. A method of destroying hidden land mines, comprising the following steps:

(a) providing a hole in the ground of a mine-contaminated area;

(b) providing a device adapted to generate a shock wave by wire explosion;

(c) placing the device into the hole;

(d) connecting the device to a switchable current source; and (e) applying a current pulse from the current source the device for causing a wire explosion thereof to generate a shock wave in the ground for destroying mines hidden in the area within the effective range of the shock wave.

2. The method as defined in claim 1, further comprising the step of performing step (a) by means of an autonomous vehicle.

3. The method as defined in claim 1, further comprising the step of performing step (a) by means of an earth boring device.

4. The method as defined in claim 1, further comprising the step of performing step (a) by means of a high-pressure water jet.

5. An apparatus placeable in a hole in the ground for destroying hidden land mines in a mine-contaminated area, comprising (a) a plastic tube filled with a liquid and having opposite ends;

(b) a wire passing through said liquid; and (c) electrodes disposed at said opposite ends; said wire being connected to said electrodes, and said electrodes being connectable to a current source for applying a current pulse to said wire to effect explosion thereof for generating a shock wave to destroy hidden land mines within a range of the shock wave.

6. The apparatus as defined in claim 5, wherein said liquid is water.

* * * * *